US012366157B2

(12) United States Patent
Prill et al.

(10) Patent No.: US 12,366,157 B2
(45) Date of Patent: Jul. 22, 2025

(54) WELLBORE LOGGING DEVICE

(71) Applicant: SENTIENT TOOLS ENGINEERING CORPORATION, Edmonton (CA)

(72) Inventors: Jonathan Ryan Prill, Edmonton (CA); Nasim Morawej, Edmonton (CA)

(73) Assignee: 2658738 Alberta Ltd., Edmonton (CA)

( * ) Notice: Subject to any disclaimer, the term of this patent is extended or adjusted under 35 U.S.C. 154(b) by 0 days.

(21) Appl. No.: 17/788,100

(22) PCT Filed: Jan. 15, 2021

(86) PCT No.: PCT/CA2021/000003
§ 371 (c)(1),
(2) Date: Jun. 22, 2022

(87) PCT Pub. No.: WO2021/142530
PCT Pub. Date: Jul. 22, 2021

(65) Prior Publication Data

US 2023/0034975 A1 Feb. 2, 2023

Related U.S. Application Data

(60) Provisional application No. 63/028,937, filed on May 22, 2020, provisional application No. 62/961,649, filed on Jan. 15, 2020.

(51) Int. Cl.
*E21B 47/013* (2012.01)
*E21B 47/017* (2012.01)
*E21B 47/02* (2006.01)

(52) U.S. Cl.
CPC ..... *E21B 47/013* (2020.05); *E21B 47/017* (2020.05); *E21B 47/02* (2013.01)

(58) Field of Classification Search
CPC ..... E21B 47/013; E21B 47/017; E21B 47/02
See application file for complete search history.

(56) References Cited

U.S. PATENT DOCUMENTS 8,922,988 B2 * 12/2014 Swett ..... H05K 5/0213 361/679.36
9,819,057 B2 * 11/2017 Suh ..... H01M 10/0567
(Continued)

FOREIGN PATENT DOCUMENTS

CN 106869808 A 6/2017
CN 110318728 A 10/2019
WO 2014145259 A2 9/2014

OTHER PUBLICATIONS

Texas Instruments, SM470R1B1M-HT, Jun. 16, 2015, p. 5.*
(Continued)

*Primary Examiner* — Nicole Coy
*Assistant Examiner* — Nicholas D Wlodarski
(74) *Attorney, Agent, or Firm* — Donald V. Tomkins

(57) ABSTRACT

A wellbore logging device incorporating selected electronic sensors and a power source is sealingly and removably embeddable within an instrumentation recess formed in a new or existing downhole equipment component such as a downhole tool or other component of a bottomhole assembly (BHA) in a tubular string such as a drill string. The logging device may be a modular device comprising an electronics module incorporating the electronic components, and a power module incorporating one or more energy cells. The electronics module and power module are engageable to form the logging device for insertion into an instrumentation recess, and to enable energization of the sensors and data transfer between the modules. In alternative embodiments, the logging device is a unitary device incorporating both the electronic components and the energy cells.

17 Claims, 12 Drawing Sheets

(56) References Cited

U.S. PATENT DOCUMENTS

| | | | | |
|---|---|---|---|---|
| 10,653,027 | B2 * | 5/2020 | van Pol | G01D 11/245 |
| 2006/0065395 | A1 | 3/2006 | Snell | |
| 2014/0284104 | A1 | 9/2014 | Clausen et al. | |
| 2018/0066513 | A1 * | 3/2018 | Sugiura | E21B 7/06 |
| 2018/0080310 | A1 | 3/2018 | Sorenson et al. | |
| 2020/0370422 | A1 * | 11/2020 | Finke | E21B 49/10 |
| 2021/0238982 | A1 * | 8/2021 | Schulte | E21B 33/12 |
| 2022/0216554 | A1 * | 7/2022 | Lopotko | H01M 50/184 |

OTHER PUBLICATIONS

International Search Report re PCT/CA2021/000003, completed by the ISA/CA on Mar. 11, 2021 and issued by the ISA/CA on Apr. 16, 2021.

Written Opinion of the International Searching Authority re PCT/CA2021/000003, completed by the ISA/CA on Mar. 15, 2021 and issued by the ISA/CA on Apr. 16, 2021.

*Arctic Cat Inc.* v. *GEP Power Products, Inc.* (CAFC—Mar. 26, 2019).

Wikipedia article re "Modularity" (as downloaded Nov. 4, 2024).

* cited by examiner

WELLBORE LOGGING DEVICE

FIELD

The present disclosure relates in general to methods and systems for providing reliable data with respect to the performance and operational status of downhole equipment deployed in wellbores such as oil and gas wells, as well as data with respect to the downhole environment in which the downhole equipment is operating. The present disclosure relates in particular to methods and systems for fitting both new and existing downhole equipment components with instrumentation (such as sensors) for gathering and recording performance, status, and downhole environment data.

BACKGROUND

In drilling a borehole in the earth, such as in exploration and recovery of hydrocarbons, a drill bit is connected on the lower end of a drill string incorporating an assembly of drill pipe sections connected end-to-end. In some cases, the drill string and drill bit are rotated by a drilling table or top drive at the surface, and in other cases the drill bit is rotatable by a downhole motor incorporated into the drill string above the bit, while portions of the drill string above the downhole motor rotate at a slower speed or not at all. Typically, the downhole motor is a Moineau-type progressive cavity motor that derives power from drilling fluid (commonly referred to as "drilling mud", or simply "mud") pumped under pressure from the surface, through the drill string and then through the downhole motor (alternatively referred to as a "mud motor").

In many cases, other downhole equipment is also incorporated into the drill string, either in series with the mud motor, or independent of the mud motor. Examples of such additional downhole equipment include rotary steerable systems ("RSS"), measurement-while-drilling ("MWD") systems, logging-while-drilling ("LWD") systems, jars, accelerators, safety joints, and agitation systems. The drill string may further include specialized tools designed for specific uses, such as (to give only one example) for "fishing operations"—i.e., where a broken and disconnected portion of a previously-used drill string has been lost in the wellbore, and a second drill string is deployed into the wellbore to retrieve the lost portion of the drill string. Such specialized drill strings may incorporate downhole equipment such as overshots or spears, fishing jars, accelerators, and/or agitation systems to assist in the capture and removal of the disconnected drill string from the wellbore.

Development and operational evaluation of new downhole equipment can be very challenging, especially when the downhole equipment is solely mechanical in nature. Related data measured and recorded on the drilling rig is commonly insufficient to provide a reliable understanding of the conditions in which the downhole equipment is being operated, due to the substantial physical distance between the surface measurement sensors and the downhole equipment in the wellbore. As well, it is common in the drilling industry for downhole equipment to be rented, which in some cases may make it all the more important or desirable to have reliable measurements and data relating to the performance of the rented equipment in a downhole environment in order to assess whether the downhole equipment is performing as the equipment renter or supplier may have claimed it would.

There exists a large worldwide inventory of mechanical downhole equipment, but there is a general reluctance to upgrade or modify such existing equipment to incorporate or enable the incorporation of electronic sensors and/or other means for providing reliable data relating to the operation of downhole equipment and its downhole operating environment. Minor modifications to existing downhole equipment may be acceptable in some cases, but typically only if the modifications would not affect the structural integrity or specifications of the existing downhole equipment, and provided that the cost of the modifications is reasonable relative to the benefits that may be provided by the modifications. For these reasons, the practical feasibility of integrating additional electronic measurement and monitoring equipment into either existing or new downhole equipment components may depend to a significant extent on the physical size of the electronic measurement equipment, which will typically be constrained by the physical size and configuration of the downhole components in question.

BRIEF SUMMARY

The present disclosure teaches devices and systems for integrating electronic sensors and/or other measurement and monitoring equipment into both new and existing downhole equipment components, without necessitating modifications that would significantly affect the cost or functionality of the components in question. More specifically, the present disclosure teaches embodiments of wellbore logging devices that incorporate selected sensors and other electronic components, including microprocessors and data memories, as well as power sources (e.g., batteries) for powering the electronic components, and which are sealingly and removably embeddable within instrumentation recesses formed in either new or existing equipment components. For example, the instrumentation recesses may be machined or otherwise formed in outer surfaces of tubular bottomhole assembly (BHA) components having sufficiently thick walls to enable embedment of the logging devices without intercepting the bores of such tubular components.

Accordingly, in a first aspect the present disclosure teaches embodiments of a wellbore logging device comprising an electronics assembly and a power source for energizing the electronics assembly, in which the electronics assembly comprises a plurality of electrical components including includes one or more sensors, one or more memory devices, a printed circuit board (PCB), and a computer-enabled connection port; and one or more of the memory devices configured to record downhole environmental data gathered by one or more of the sensors. The sensors may include a solid-state silicon-based gyroscope configured to sense rotation of a drill string; one or more first accelerometers configured to measure acceleration of a drill string; and a temperature sensor configured to measure the ambient temperature of a drill string.

In one embodiment, each of the one or more first accelerometers comprises a plurality of primary accelerometers, each of which is oriented orthogonally relative to each other primary accelerometer. The wellbore logging device may also include one or more second accelerometers configured to measure downhole environmental data with a resolution different from the resolution with which the first accelerometer is configured to measure downhole environmental data. In a variant of this embodiment, the one or more first accelerometers comprise a set of two or more first accelerometers, and the one or more second accelerometers comprise a set of two or more second accelerometers. Each set of first accelerometers and each set of second accelerometers is oriented orthogonally relative to each other set of first accelerometers and each other set of second accelerometers.

The wellbore logging device may also include a pressure sensor coupled to the electronics assembly and configured to read a pressure associated with a drill string; plus a load sensor configured to read a force associated with a downhole tool incorporated in a drill string.

The electronics assembly of the wellbore logging may be configured to record downhole environmental data from the one or sensors at a rate of at least about 100 hertz (Hz), or at a rate of at least about 1,000 Hz.

In preferred embodiments, the largest dimension of the wellbore logging device is less than or equal to about 2.0 inches, less than or equal to about 1.5 inches, or less than or equal to about 1.38 inches. However, these dimensional limits are by way of non-limiting example only, and the scope of the present disclosure and claims is intended to cover embodiments in which the largest dimension of the wellbore logging device exceeds 2.0 inches.

In preferred embodiments, one or more of the electrical components may be non-manufacturer-rated for service in downhole environmental conditions.

In certain embodiments, the wellbore logging device is a modular device comprising an electronics module housing the electronics assembly; plus a power module housing the power source, and removably mountable to the electronics module so as to energize electronic components of the electronics assembly.

In a second aspect, the present disclosure teaches embodiments of a downhole equipment component having a wellbore logging device in accordance with any of the hereindisclosed embodiments embedded within a cylindrical wall of the downhole equipment component. The wellbore logging device may be disposed within an instrumentation recess formed into an outer surface of the cylindrical wall of the equipment component. The wellbore logging device is preferably protected by a pressure cap that is sealingly and removably disposed within the instrumentation recess after the wellbore logging device has been positioned therein. The pressure cap may incorporate a heat-resistant and abrasion-resistant viewing window enabling personnel to view light signals generated by the logging device to communicate various types of information relating to the logging device and/or the downhole component.

BRIEF DESCRIPTION OF THE DRAWINGS

Embodiments will now be described with reference to the accompanying Figures, in which numerical references denote like parts, and in which.

TERMINOLOGY AND INTERPRETATION

Figures 1A, 1B:
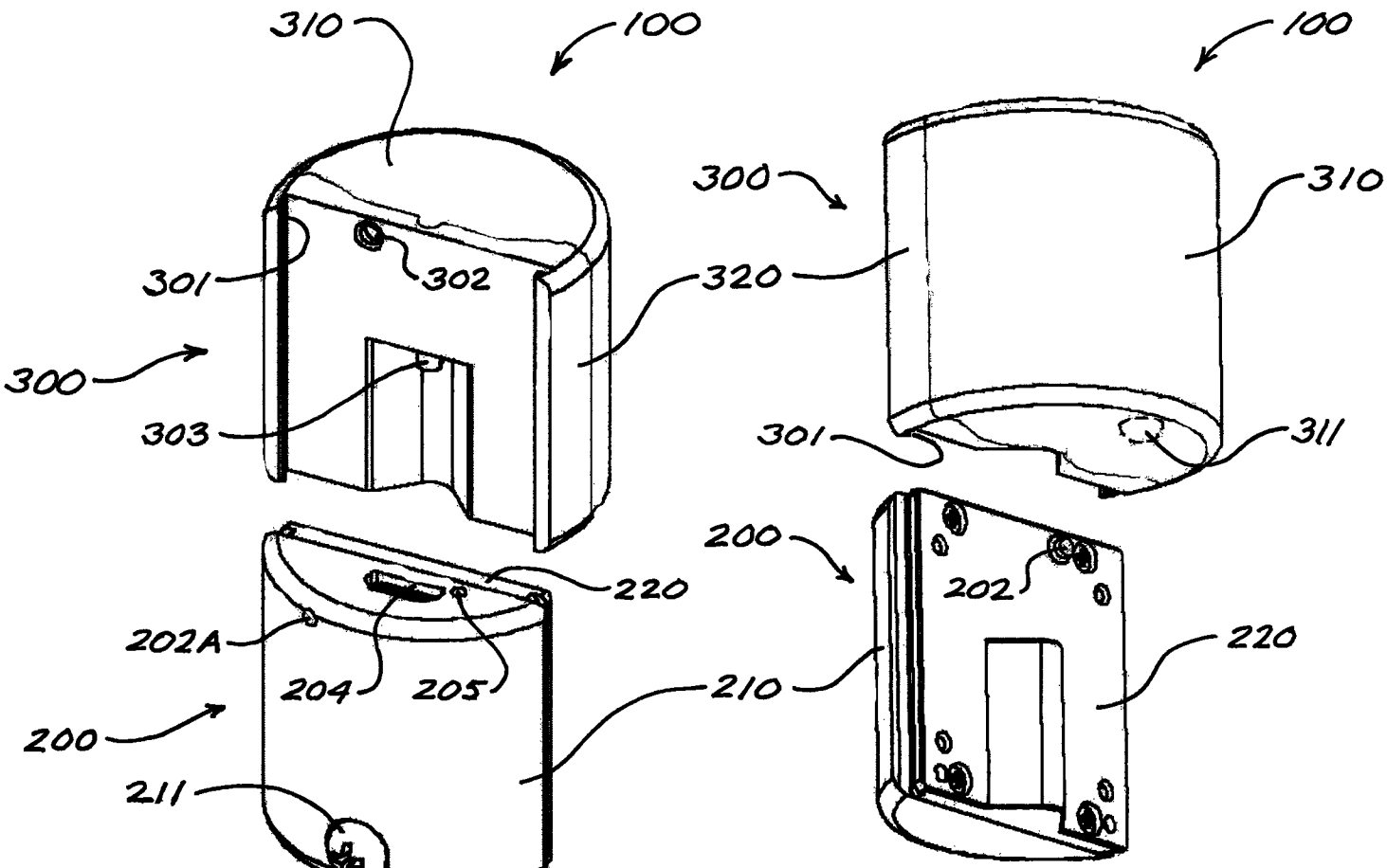
FIGS. 1A and 1B, respectively, are downward-looking and upward-looking isometric views of the electronics module and power module of a first embodiment of a wellbore logging device in accordance with the present disclosure, shown in alignment for assembly.

Terms used in this disclosure to refer to particular elements and components of disclosed and claimed embodiments may differ from terms used by drilling equipment companies or others in the field with reference to the same elements or components. This disclosure does not intend to distinguish between components that differ in name but not in function, and for greater certainty and clarity in this regard, certain terms used herein are intended to be understood and interpreted in accordance with the following specific meanings:

- The term "Drill String" denotes all of the tubular components assembled to connect a drill bit to a drilling rig, including the BHA (defined below).
- The term "Drill Pipe" denotes tubular components making up the drill string above the BHA and creating a fluidic conduit for circulating a flow of pressurized drilling fluid to the drill bit to facilitate drilling through subsurface materials.
- The term "BHA" (or "Bottom Hole Assembly") denotes an assembly of specialized drill string components (such as drill collars and one or more downhole tools) threadingly attached to the bottom of the drill pipe.
- The term "PCB" denotes a printed circuit board (or an assembly of printed circuit boards) including all electronic components mounted thereon or thereto.

DETAILED DESCRIPTION

Modular Wellbore Logger Embodiments

FIGS. 1A, 1B, 2A, 2B, 3, 4, and 5 illustrate an embodiment 100 of a wellbore logging device in accordance with the present disclosure, and comprising an electronics module 200 incorporating selected electronic wellbore logging components, and a power module 300 incorporating one or more chemical energy cells (batteries) of any suitable type. In this particular embodiment, electronics module 200 and power module 300 are slidingly engageable by means of a T-shaped slot 301 in power module 300 and a corresponding T-shaped protrusion 201 in electronics module 200. In variant embodiments, a dovetail-type slot of any functionally suitable configuration may be used instead of a T-shaped slot to enable sliding engagement of electronics module 200 and power module 300. The ability to disengage power module 300 from electronics module 200 with a fresh power module is desirable to enable re-use of electronics module 200 in other wellbores after the batteries in the original power module 300 have been depleted.

As illustrated, electronics module 200 and power module 300 may be operatively connected (by way of non-limiting example) by engagement of a power terminal 303 on power module 300 with a mating power socket 203 on electronics module 200.

Electronics module 200 and power module 300 may be removably secured to each other by any suitable means, such as a retaining screw or set screw 202 rotatable within a threaded hole 202A in electronics module 200 and a complementary threaded hole 302 in power module 300 as illustrated in FIGS. 1A and 1B. Other means for removably securing electronics module 200 to power module 300 include (but are not limited to) cam lock mechanisms and locking devices comprising a spring-ball detent.

Optionally, power module 300 may incorporate an electronic memory device (not shown) for storing configuration information and other data related to the battery use and/or the downhole (or other) environment in which it has been used. The electrical connection between power module 300 and electronics module 200 may be adapted to facilitate electronic communication with the memory device. In alternative embodiments, the memory device could also include a logic unit and/or a microprocessor and/or one or more sensors.

Electronics module 200 optionally may include a computer-enabled connection port, such as (by way of non-limiting example) a micro-USB connection or a USB port 204 as shown in FIG. 1A. Additionally, an indicator port 205 optionally may be provided adjacent to USB port 204 to allow light from a light-emitting diode ("LED") to escape the chassis of electronics module 200 and provide a visual indication to the user. Optionally, the LED could be configured to emit multiple colours and/or sequences of flashes to provide different messages or informative indications to the user.

In the illustrated embodiment, electronics module 200 comprises an outer chassis 210 and an inner chassis 220 that removably connected to each other by any suitable means, such as (by way of non-limiting example) alignment dowels or pins 206 and retention screws 207 as shown in FIG. 1B. Outer chassis 210 thus serves as a protective cover can be removed from inner chassis 220 for access to a logger PCB (not shown) encapsulated or otherwise disposed within inner chassis 220.

Power module 300 incorporates one or more chemical energy cells (not shown), such as lithium cells (by way of non-limiting example). These energy cells are electrically connected via wires and protection diodes to ensure safe and continuous operation as is typical in the art. Chemical energy cells incorporated into power module 300 are not in any way limited to any particular style, physical shape, or battery technology.

The only practical limitation with respect to chemical energy cells for purposes of power module embodiments in accordance with the present disclosure is that they be physically containable within the geometric form of a given power module as may be dictated by dimensional constraints arising from the space available for providing or forming a corresponding instrumentation recess in the particular drill string component in which the logging device is to be removably embedded. This imparts a degree of advantageous modularity to electronic logging devices in accordance with the present invention, in that the original power module of a given logging device can be readily replaced with a new and/or different power module, either to replace a depleted original power module or to replace the original power module with a new power module that has greater power and/or longer service life (such as due to future advancement in battery technology), and in all of these cases without needing to replace the original electronics module of the logging device.

In the illustrated embodiment, power module 300 comprises a battery chassis 320 that interfaces with inner chassis 220 of electronics module 200 in the assembled wellbore logging device 100 (as may be understood with reference to FIGS. 1A, 1B, 2A, and 2B). Battery chassis 320 may be provided in the form of a machined plate or in any other functionally suitable form. Power module 300 may be manufactured by affixing the energy cell(s) to battery chassis 320, wiring an internal PCB to power terminal 303 and to the energy cells (preferably with protection diodes being provided to ensure no reverse energy flow into the cells), then placing this assembly in a mould and introducing a silicone potting compound (or other suitable material) into the mould to form an outer power module block 310. Outer power module block 310 may be fixed to battery chassis 320 by any effective means, such as by providing battery chassis 320 with slots or protrusions into or around which the potting compound can flow so as to mechanically anchor the solidified potting material to battery chassis 320.

Figure 2B:
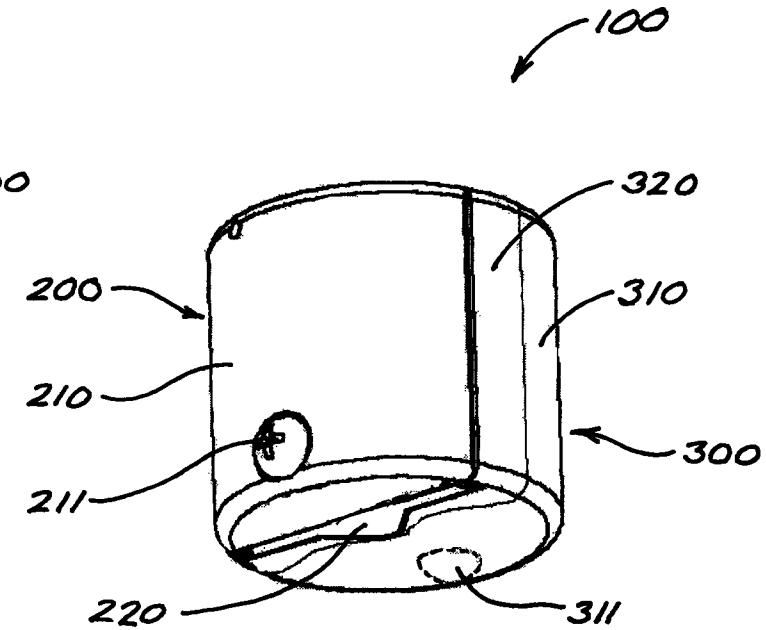
FIGS. 2A and 2B, respectively, are downward-looking and upward-looking isometric views of the wellbore logging device as in FIGS. 1A and 1B, after assembly of the electronics module with the power module.

In this embodiment, an orientation nub 311 is moulded into outer power module block 310 (as shown in FIGS. 1B and 2B) for maintaining logging device 100 in a desired orientation relative to a downhole component in which logging device 100 will be installed (as described later herein).

Figure 2A:
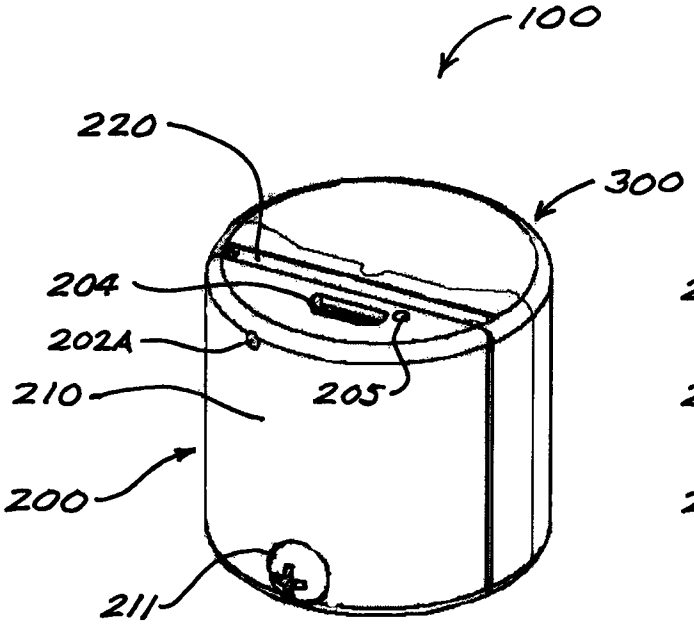

Alternatively, the desired orientation of logging device 100 may be maintained by providing a suitable orientation nub on electronics module 200, illustrated in FIGS. 1A, 2A, and 2B (by way of non-limiting example), in the form of a round-headed machine screw 211 installed in a mating threaded hole (not shown) in outer logger chassis 210. It would not be necessary to provide orientation nubs on both electronics module 200 and power module 300, and for this reason orientation nub 311 is shown in broken outline in FIGS. 1B and 2B to indicate that orientation nub 311 is alternative to orientation nub 211 and not additional to it.

Although electronics module 200 of logging device 100 has been described and illustrated herein as comprising inner and outer logger chassis, this is by way of non-limiting example only. In variant embodiments, electronics module 200 could be made as a unitary component using suitable moulding techniques (such as injection moulding) or other known or future-developed manufacturing processes (such as metal 3D printing).

Figure 3:
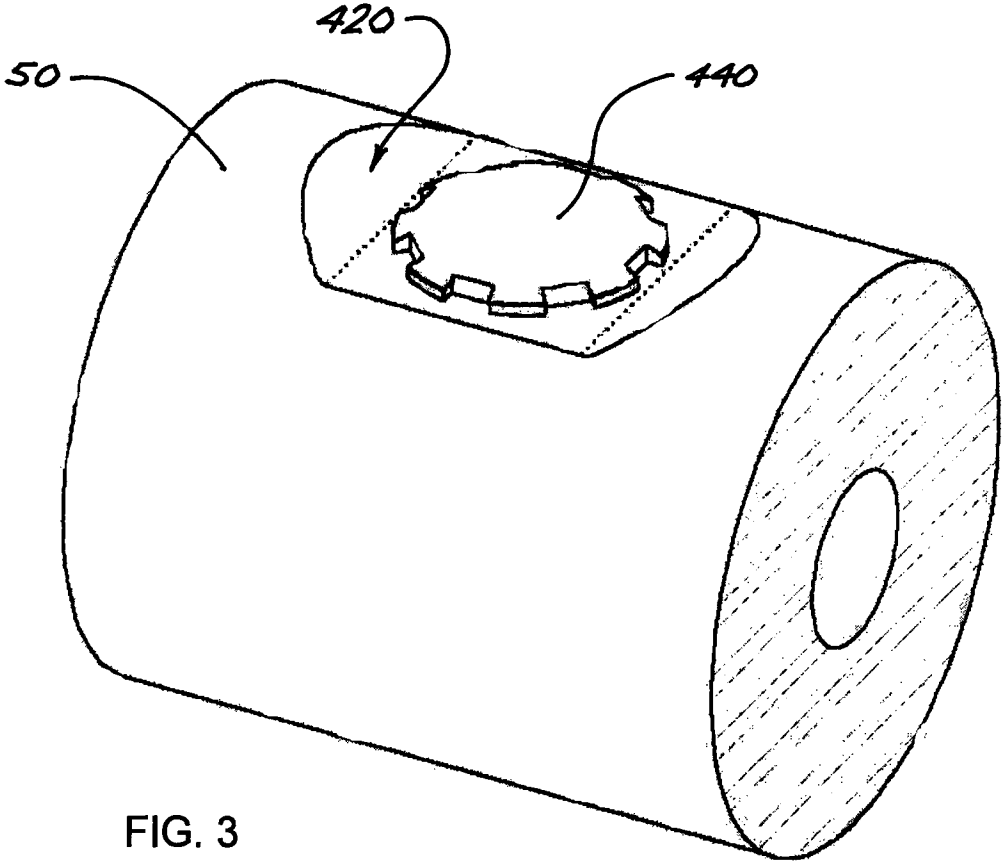
FIG. 3 is an isometric view of a segment of a tubular drill string component as seen after embedment of a wellbore logging device as in FIGS. 2A and 2B within an instrumentation recess formed in a wall of the tubular component and fitted with a pressure cap for protection of the embedded logging device.
Figure 4:
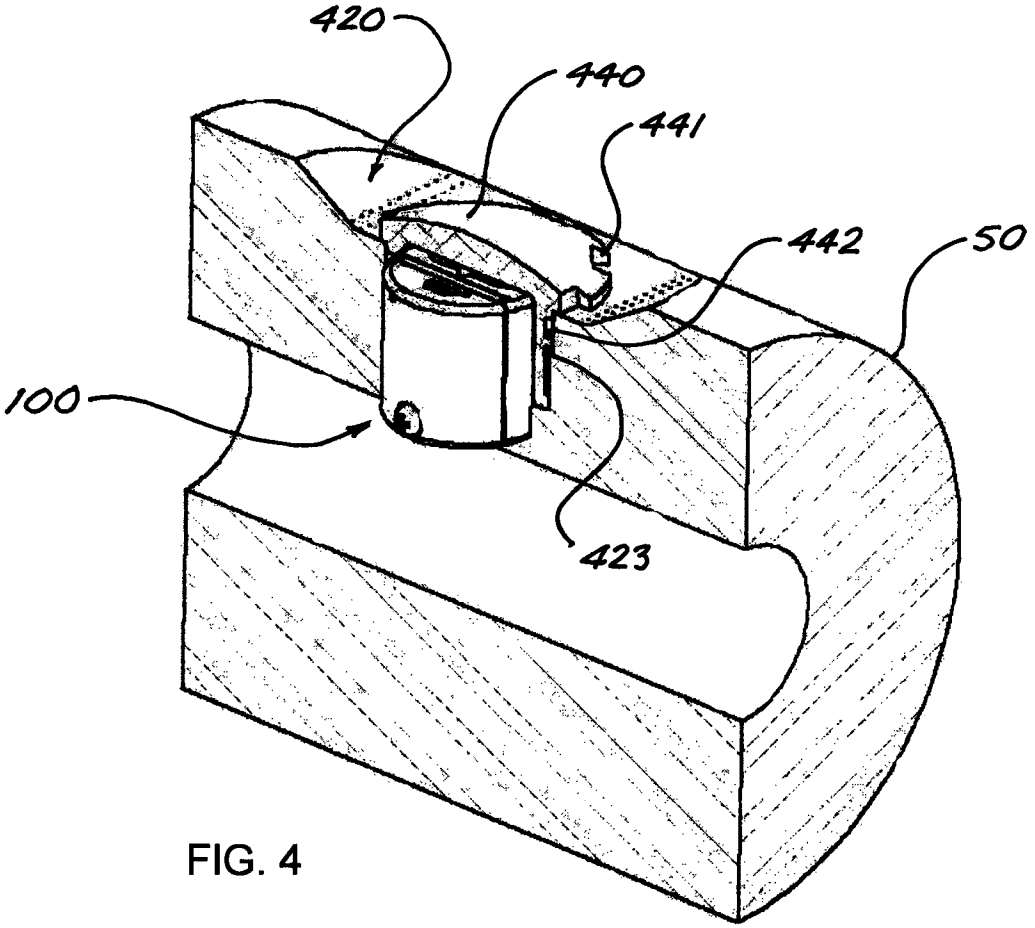
FIG. 4 is an isometric longitudinal section through the tubular component segment in FIG. 3, showing the embedded logging device and pressure cap.

FIGS. 3 and 4 illustrate the installation of wellbore logging device 100 in an instrumentation recess 420 machined into the cylindrical wall of a BHA component 50 (shown by way of non-limiting example as a thick-walled tubular drill collar). A pressure cap 440 is threadingly engageable with threading 421 provided in instrumentation recess 420, with a pressure seal 442 being assembled on the cylindrical perimeter of pressure cap 440 to create a fluidic seal between pressure cap 440 and a seal surface 423 provided in instrumentation recess 420 to protect logging device 100 from wellbore pressure and fluids. In the illustrated embodiment, pressure cap 440 includes a castellation feature has a castellated perimeter 441 engageable with a mating wrench (not shown) for tightening pressure cap 440.

Figure 5:
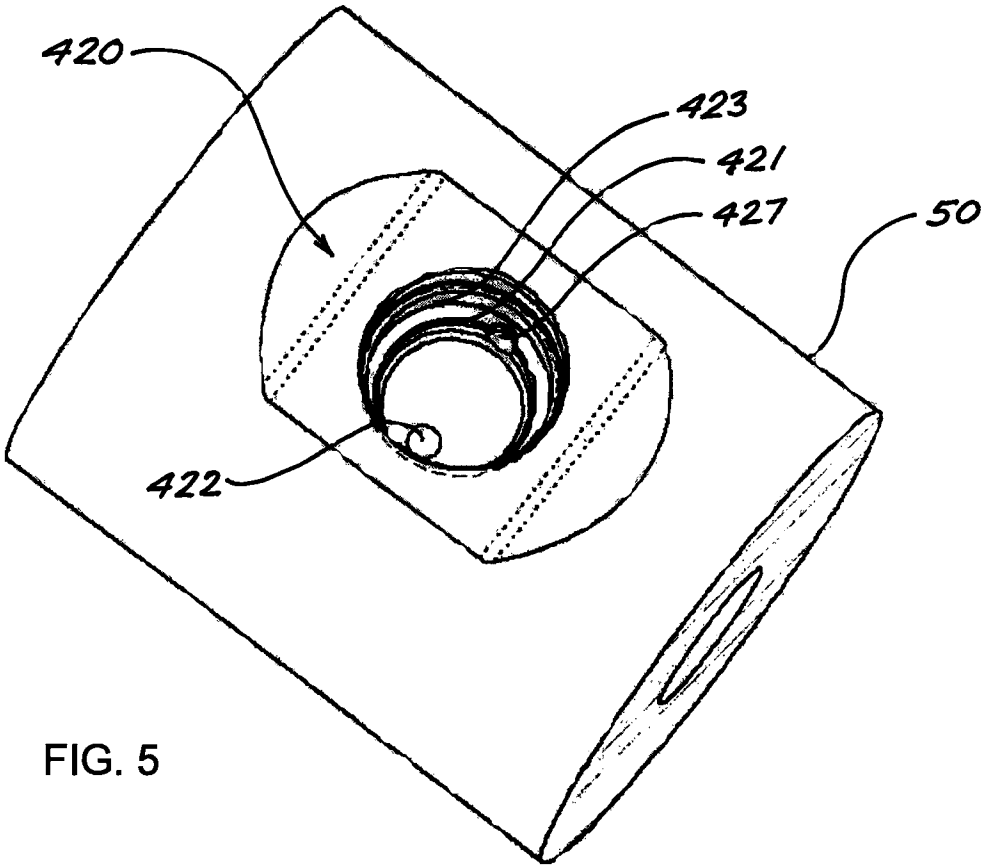
FIG. 5 is an isometric view of the instrumentation recess in the tubular component segment in FIGS. 3 and 4, shown prior to embedment of the logging device, and illustrating alternative locations for a pocket in the instrumentation recess for receiving an orientation nub protruding from the logging device.
Figure 6B:
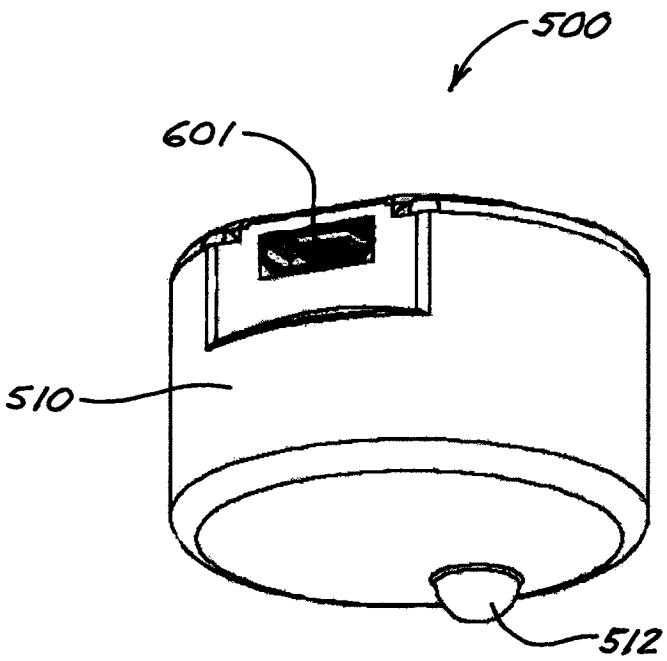
FIGS. 6A and 6B, respectively, are downward-looking and upward-looking isometric views of a second embodiment of a wellbore logging device in accordance with the present disclosure, comprising an electronics assembly encapsulated within a device housing provided with a device orientation nub.
Figure 6A:
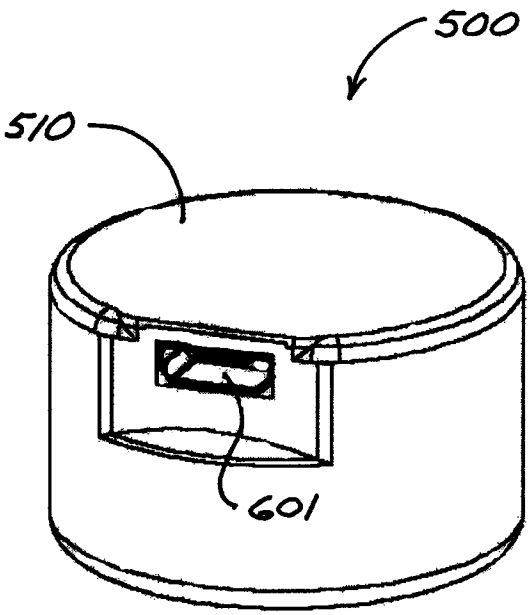

FIG. 5 illustrates instrumentation recess 420 in BHA component 50 prior to installation of logging device 100, and shows a nub pocket 422 formed in a lower surface of instrumentation recess 420 for engagement with an orientation nub 311 projecting from the bottom of power module 300 of logging device 100 as shown in FIGS. 1B and 2B. Because orientation nub 311 and the corresponding nub pocket 422 are offset from the common centerline of logging device 100 and recess 420, there is only one orientation in which logging device 100 can be installed in recess 420.

FIG. 5 also illustrates an alternative nub pocket 427 formed in a sidewall of instrumentation recess 420 for engagement with an orientation nub 211 projecting radially outward from electronics module 200 of logging device 100 as shown in FIGS. 1A, 2A, and 2B.

The electronics PCB (not shown) encapsulated in electronics module 200 may contain a logic unit, power conditioning circuitry, non-volatile memory, and one or more sensors, including but not limited to accelerometers, gyroscopes, temperature sensors, pressure sensors, strain sensors, and/or radiation sensors (e.g., gamma detectors). The state of the art teaches that electronic components used in harsh environments need to be qualified by their manufacturer to be suitable for use in high-temperature environments. Contrary to what the art teaches, consumer-grade or commercial-grade components rated at much lower temperature or vibration environments may significantly outperform their manufacturers' specified ratings.

In a preferred embodiment, wellbore logging device 100 incorporates three discrete memory devices, as follows:

1. a high-density primary memory device qualified and tested for use outside its manufacturer's rating, and incorporated in electronics module 200, and having capacity to store large amounts of raw data records;
2. a medium-density secondary memory device (or "backup memory") rated by its manufacturer for use in harsh operating environments and incorporated in electronics module 200, for storing a summary of the high-density data stored in the primary memory; and
3. a low-density tertiary memory device (or "battery memory") incorporated in power module 300, for storing battery capacity and battery operational parameters for the battery, as well as data related to battery use and the environment in which it was used.

The secondary (or backup) memory provides a backup of the collected data so that in the event of damage to the primary memory, at least some data from the primary memory will be recoverable. Because the backup memory contains only summaries of the primary memory data, the amount of data on the backup memory will typically be orders of magnitude less than the amount of data on the primary memory and therefore can be downloaded very quickly. In a typical embodiment, the secondary memory can be completely downloaded in as little as one or two minutes, whereas the primary memory could take 4 to 8 hours to download.

The tertiary (or battery) memory makes it possible to use the power module 300 of a given logging device 100 in a different logging device 100, with the battery capacity and operational data remaining with the power module.

Wellbore Logger Embodiments for Monitoring Equipment Status and Condition

Figure 7:
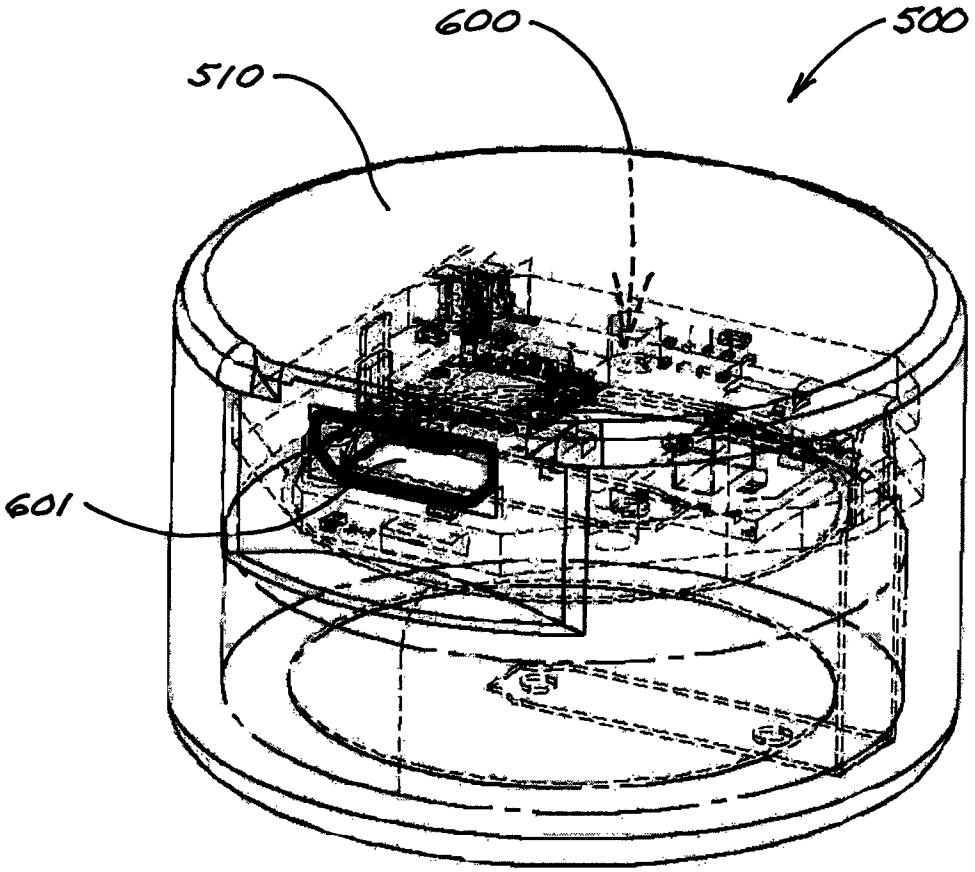
FIG. 7 is a semi-transparent isometric view of a wellbore logging device as in FIGS. 6A and 6B, conceptually illustrating (in broken outline) components of the electronics module encapsulated within the electronics module housing.

FIGS. 6A, 6B, 7, 8, 9, and 10 illustrate an embodiment 500 of a wellbore logging device in accordance with the present disclosure comprising an electronics assembly 600 encapsulated within a moulded device housing 510 formed by means of a potting process whereby an insulating liquid compound is poured into a mould in which electronics assembly 600 has been positioned. FIG. 7 is a semi-transparent view of logging device 500 showing encapsulated electronics assembly 600. Electronics assembly 600 is electronically accessible via a computer-enabled connection port 601 (shown by way of example as a USB port) that extends to the perimeter of device housing 510.

Prior to the moulding process, electronics assembly 600 is connected to an energy cell. Optionally, device housing 510 may be made from a transparent or semi-transparent (translucent) potting compound to enable visual indications to operators or service personnel, by means of light signals from a light-emitting diode (LED, not shown) included in electronics assembly 600, thus providing direct feedback with respect to parameters such as (but not limited to) battery level, remaining data storage capacity, and status of computer connectivity. Transparent housing 510 can act as a simple lens to disperse the light emitted from the LED so that it is more readily apparent to operators. Providing users with direct visual feedback from logging device 500 may enable an improved user experience by increasing efficiency, since it would not need to be connected to a computer in order to communicate selected types of information to the operator. If desired, however, information stored in memory in electronics assembly 600 can be electronically accessed via connection port 601.

In the illustrated embodiment, device housing 510 is shown as having an orientation nub 512 (generally similar to the previously-described orientation nub 311 on power module 300 of wellbore logging device 100) for retaining accelerometers, gyroscope sensors, and/or other orientation-based sensors included in electronics assembly 600 in desired alignment or angular orientation after logging device 500 has been installed in a downhole equipment component. The configuration and location of orientation nub 512 could vary provided that it functions to prevent misalignment of the encapsulated sensors caused by undesirable rotation relative to the downhole equipment component due to any cause (e.g., vibration, insufficient care taken during installation, human error, etc.).

Conventional downhole data loggers typically include an additional housing to contain the electronics and the insulating potting material. By encapsulating the electronics module within the potting material forming device housing 510, logging device 500 is an improvement over such prior art loggers because housing 510 is the only boundary between electronics assembly 600 and the downhole equipment component in which it is installed. This reduces or avoids the costs and complications of manufacturing an additional housing component for every data logger as in the prior art.

Orientation nub 512 minimizes the risk of recording undecipherable data from a run where the orientation of logging device 500 was not known or was not constant; this may lead to cost savings over prior art loggers that are more susceptible to alignment issues and therefore could yield meaningless or unreliable data.

Computer-enabled connection port 601 is always accessible when logging device 500 is not installed in downhole equipment, thereby minimizing maintenance time and costs required to access the data stored therein. As well, connection port 601 enables operators to update firmware incorporated in logging device 500, thereby reducing the possibility of older logging devices becoming obsolete due to firmware patches or upgrades.

Figure 8:
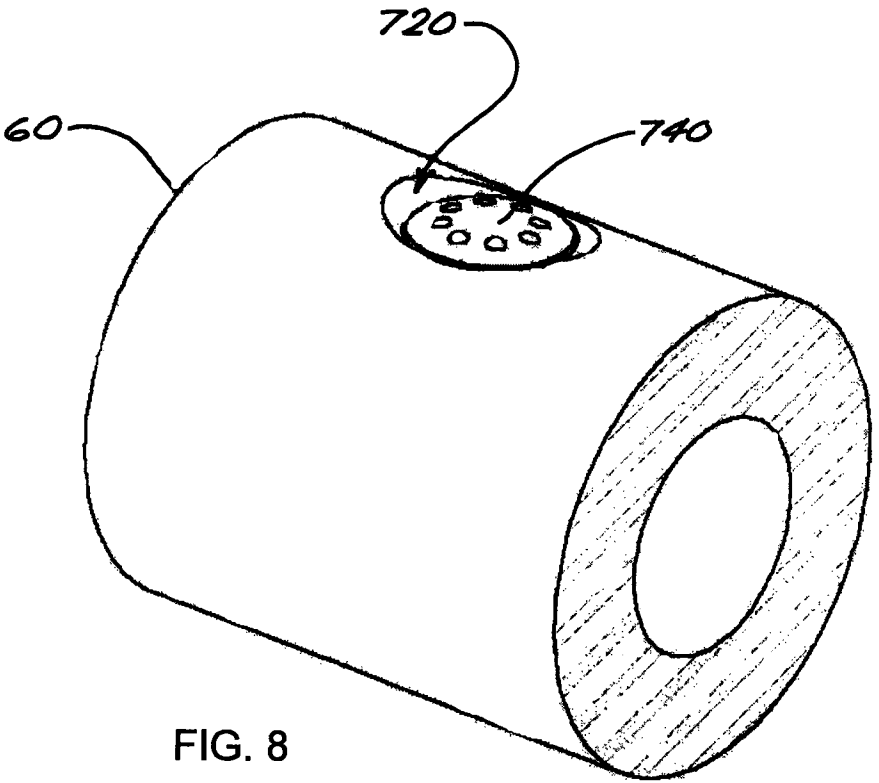
FIG. 8 is an isometric view of a segment of a tubular drill string component as seen after embedment of a wellbore logging device as in FIGS. 6A and 6B within an instrumentation recess formed in the wall of the drill string component and fitted with a pressure cap.
Figure 9:
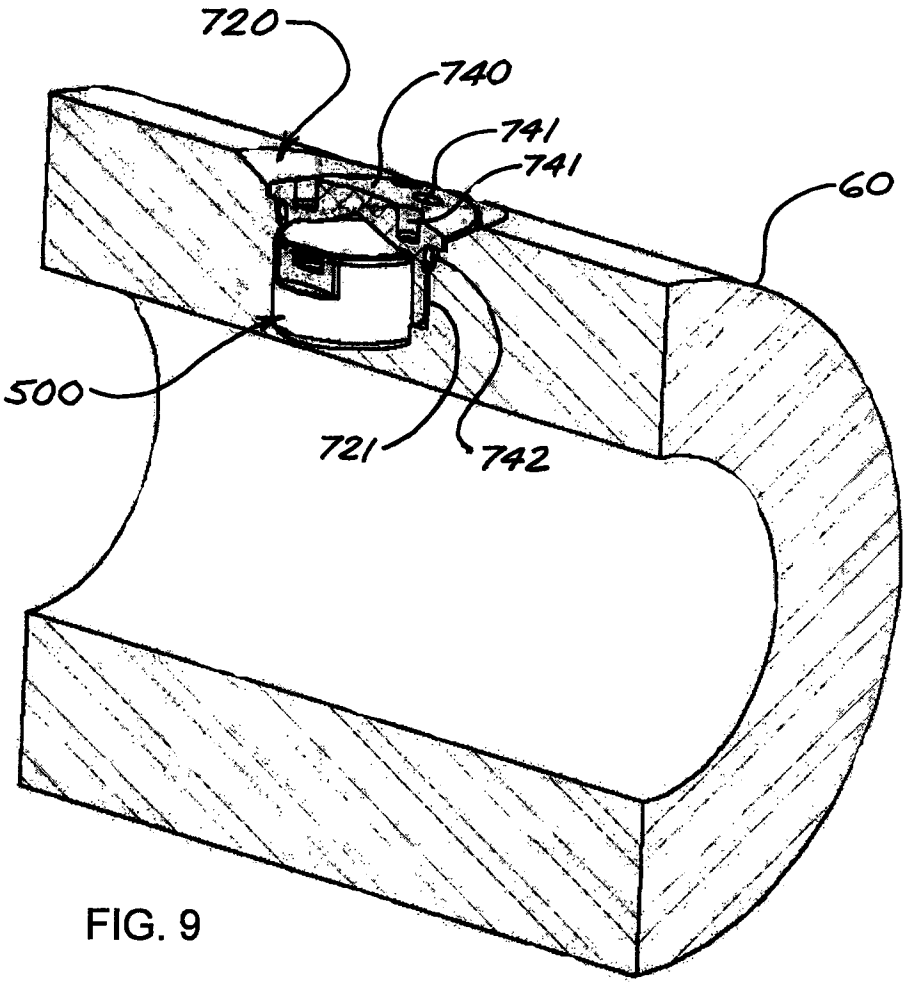
FIG. 9 is an isometric longitudinal section through the tubular component segment in FIG. 7, showing the embedded logging device and the pressure cap.

FIGS. 8 and 9 illustrate the installation of wellbore logging device 500 in an instrumentation recess 720 machined into the cylindrical wall of a tubular BHA component 60. A pressure cap 740 is threadingly engageable with threading 721 provided in instrumentation recess 720, with a pressure seal 742 being assembled on the cylindrical perimeter of pressure cap 740 to create a fluidic seal between pressure cap 740 and a seal surface 423 provided in instrumentation recess 720 to protect logging device 500 from wellbore pressure and fluids. In the illustrated embodiment, pressure cap 740 includes pattern of holes 741 engageable with a mating wrench for tightening pressure cap 740.

Figure 10:
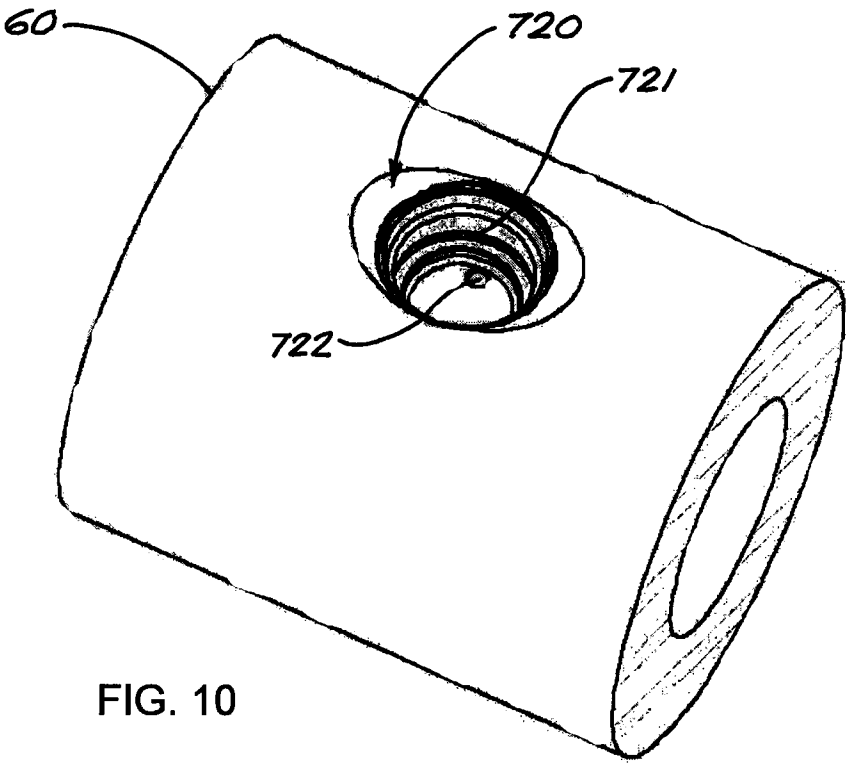
FIG. 10 is an isometric view of the instrumentation recess in the tubular component segment in FIGS. 8 and 9, shown prior to embedment of the logging device.

FIG. 10 illustrates instrumentation recess 720 in BHA component 50 prior to installation of logging device 500, and shows a nub pocket 722 formed in a lower surface of instrumentation recess 720 for engagement with orientation nub 512 projecting from the bottom of logging device 500.

In a variant embodiment, logging device 500 may incorporate a multi-coloured LED to regularly transmit, at a set frequency, a colour-coded quality rating for the downhole equipment component in which the variant logging device 500 is installed. Electronics assembly 600 determines the particular colour code transmitted by the LED at a given time by observing the total hours that the tool is subjected to drilling forces and comparing the observed total hours against a threshold value of acceptable drilling hours above which the downhole component's integrity can no longer be reliably determined or assessed without a detailed and costly inspection, as may be considered appropriate by the drilling engineer.

The visual indication feature enabled by logging device 500 will inevitably illuminate the LED at times when the operator is not present, resulting in minor but undesirable power losses. To eliminate such minor power losses, variant embodiments may be configured to respond to signals (e.g., physical vibrations, exposure to an electromagnetic field) broadcast by the operator to the logging device 700. Different drilling tools are susceptible to wear based on their individual mechanics, so this variant of logging device 500 provides means for monitoring a drilling tool's condition, and provides a visual indication once a tool has been operated beyond its acceptable operating time threshold.

This variant of logging device 500 does not need to be connected to a computer in order to relay the tool condition indication, so decisions on whether to reuse or recycle drilling tools can be made immediately, without needing to expend time inspecting the drilling tool or analyzing vibrational data from logging device 500 itself. This variant does not require any orientation nubs, because the magnitude of vibrational data will typically be adequate to monitor the drilling tool's usage. More specifically, the orientation of vibration sensor(s) used in this embodiment will be orthogonal to the longitudinal axis of the BHA component in which logging device 500 is embedded, so the angular orientation of logging device 500 relative to the axis of the BHA component in which it is embedded will not affect the readings of the vibration sensor(s).

Figure 11:
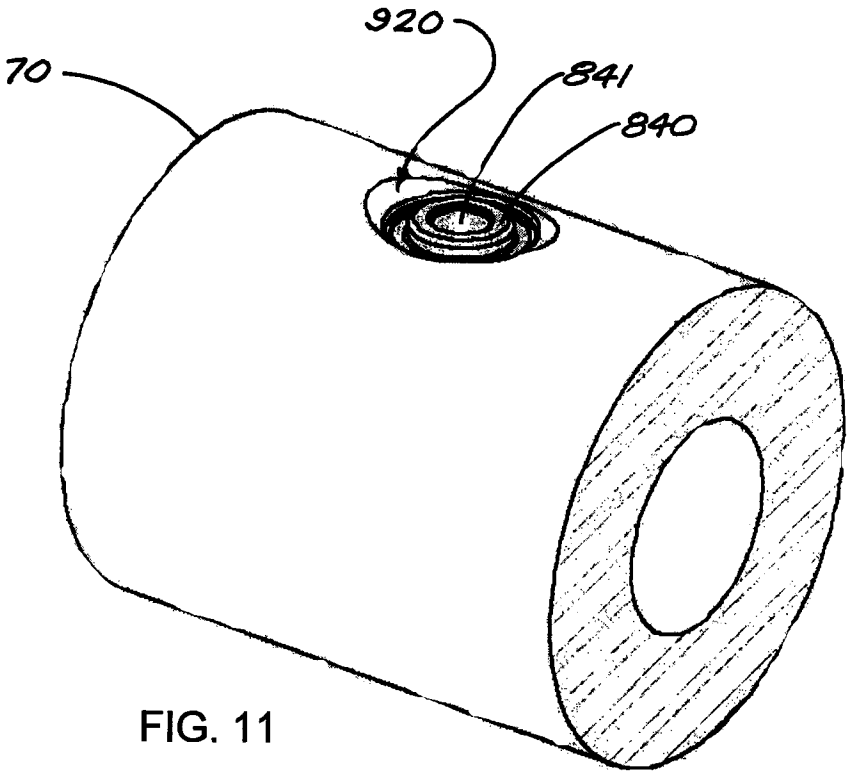
FIG. 11 is an isometric view of a segment of a tubular drill string component as seen after embedment of a wellbore logging device within an instrumentation recess formed in the wall of the tubular component and fitted with a windowed pressure cap.
Figure 12:
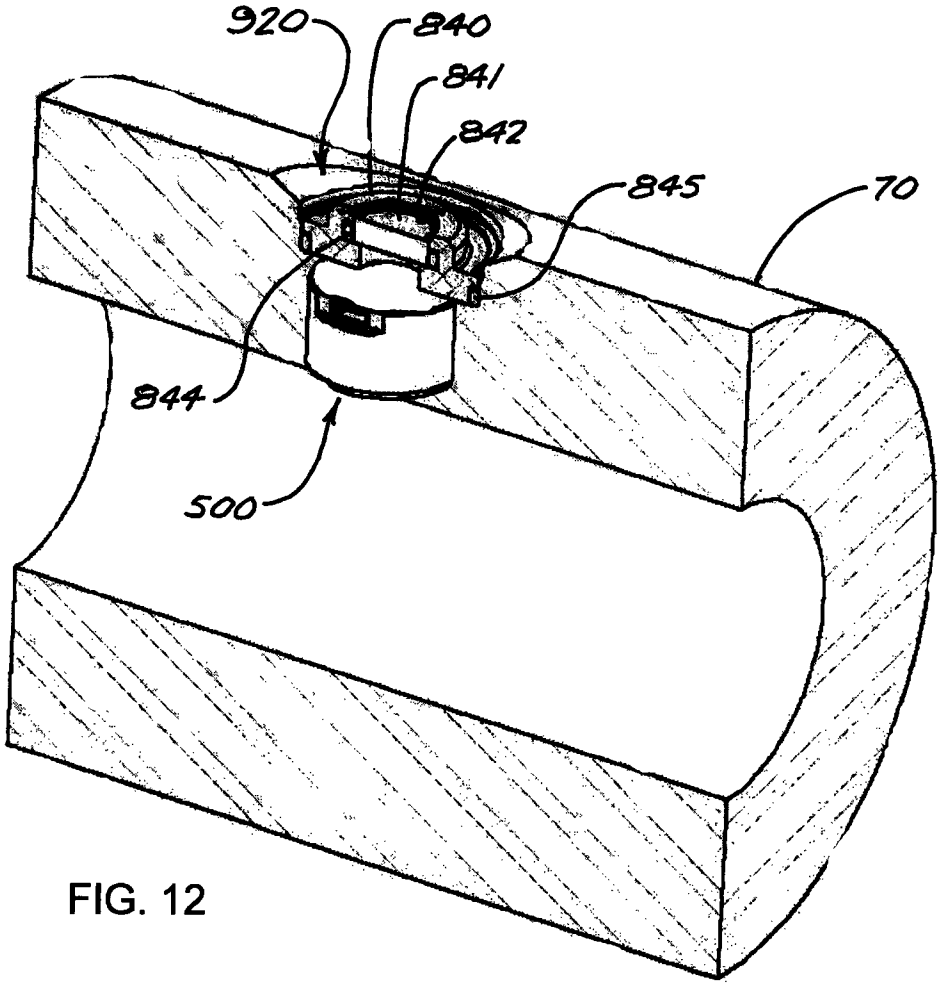
FIG. 12 is an isometric longitudinal section through the tubular component segment in FIG. 11, showing the embedded logging device and the windowed pressure cap.

FIG. 11 and FIG. 12 illustrate the installation of another variant embodiment of wellbore logging device 500 in an instrumentation recess 920 machined into the cylindrical wall of a tubular BHA component 70. A windowed pressure cap 840 is secured in recess 920 with a retaining ring 843. A pressure seal 845, installed in a groove on the outer perimeter of windowed pressure cap 840, creates a fluidic seal between a seal surface 921 on recess 920 and windowed pressure cap 840, and ensures that logging device 500 is protected from harsh wellbore pressure and fluids.

Windowed pressure cap 840 incorporates a glass disc 841, secured in place by a retaining ring 842, to provide a transparent window into instrumentation recess 920. Glass disc 841 may be made from high-strength transparent ceramic, ballistics glass, transparent aluminum (aluminum oxynitride), or from a similarly suitable material that is robust enough to maintain its transparency after being subjected to drilling pressures and prolonged surface wear from particulates in drilling mud flowing upward in the annulus between the drilling string and the wellbore. A pressure seal 844 is installed on the outer perimeter of glass disc 841 and creates a fluidic seal between glass disc 841 and windowed pressure cap 840. Windowed pressure cap 840 allows an observer to view visual indications from the installed logging device 500 immediately after the downhole component in which it is embedded has been removed from the wellbore.

Other embodiments of logging device 500 may permit a signal from outside of a windowed pressure cap to initiate data transfer, settings changes, power toggle, etc., via a sequence of visual indications beginning only when the external signal is received. Examples of such external signals may include (but are not limited to):

- visible light signals transmitted to the logging device via the transparent pathway from the surface of the downhole component;
- electromagnetic radiation transmitted through the windowed pressure cap and directly or indirectly received by the PCB;
- patterned physical vibrations (such as from a hammer blow to the windowed pressure cap) that are deciphered by the PCB; and
- magnetic stimulation of the PCB components via an external sweeping magnet.

It will be readily appreciated by those skilled in the art that various modifications to embodiments in accordance with the present disclosure may be devised without departing from the present teachings, including modifications which may use structures or materials later conceived or developed. It is to be especially understood that the scope of the present disclosure should not be limited by or to any particular embodiments described, illustrated, and/or claimed herein, but should be given the broadest interpretation consistent with the disclosure as a whole. It is also to be understood that the substitution of a variant of a claimed element or feature, without any substantial resultant change in functionality, will not constitute a departure from the scope of the disclosure or claims.

In this patent document, any form of the word "comprise" is intended to be understood in a non-limiting sense, meaning that any element or feature following such word is included, but elements or features not specifically mentioned are not excluded. A reference to an element or feature by the indefinite article "a" does not exclude the possibility that more than one such element or feature is present, unless the context clearly requires that there be one and only one such element.

Any use of any form of any term describing an interaction between elements or features (such as but not limited to "connect", "engage", "couple", and "attach") is not meant to limit the interaction to direct interaction between the elements or features in question, but may also extend to indirect interaction between the elements such as through secondary or intermediary structure.

Relational terms such as but not limited to "cylindrical" and "orthogonal" are not intended to denote or require absolute mathematical or geometrical precision. Accordingly, such terms are to be understood as denoting or requiring substantial precision only (e.g., "generally cylindrical" or "substantially orthogonal") unless the context clearly requires otherwise. Any use of any form of the term "typical" is to be interpreted in the sense of being representative of common usage or practice, and is not to be interpreted as implying essentiality or invariability.

What is claimed is:

1. A wellbore logging device comprising:

(a) an electronics module comprising an outer electronics module chassis and an inner electronics module chassis;

(b) an electronics assembly comprising a plurality of electronic components including one or more sensors, one or more memory devices, a printed circuit board (PCB), and a computer-enabled connection port; and (c) a power module comprising a battery chassis carrying a power source;

wherein:

(d) the outer electronics module chassis is connectable to the inner electronics module chassis to encapsulate the electronics assembly; and (e) when the outer electronics module chassis and the inner electronics module chassis are connected to encapsulate the electronics assembly, the power module is removably mountable to the electronics module to energize the electronics assembly by sliding engagement of the battery chassis with the inner electronics module chassis.

2. The wellbore logging device as in claim 1 wherein the one or more sensors include:

(a) a solid-state silicon-based gyroscope configured to sense rotation of a drill string;

(b) one or more first accelerometer configured to measure acceleration of a drill string; and (c) a temperature sensor configured to measure the ambient temperature of a drill string.

3. The wellbore logging device as in claim 2 wherein each of the one or more first accelerometers comprises a plurality of primary accelerometers, each of which is oriented orthogonally relative to each other primary accelerometer.

4. The wellbore logging device as in claim 2, further comprising one or more second accelerometers configured to measure downhole environmental data with a resolution different from the resolution with which the first accelerometer is configured to measure downhole environmental data.

5. The wellbore logging device as in claim 4 wherein:

(a) the one or more first accelerometers comprise a set of two or more first accelerometers;

(b) the one or more second accelerometers comprise a set of two or more second accelerometers; and (c) each set of first accelerometers and each set of second accelerometers is oriented orthogonally relative to each other set of first accelerometers and each other set of second accelerometers.

6. The wellbore logging device as in claim 1, further comprising one or both of:

(a) a pressure sensor coupled to the electronics assembly and configured to read a pressure associated with a drill string; and (b) a load sensor configured to read a force associated with a downhole tool incorporated in a drill string.

7. The wellbore logging device as in claim 1 wherein the electronics assembly is configured to record downhole environmental data from the one or sensors at a rate of at least about 100 hertz (Hz).

8. The wellbore logging device as in claim 7 wherein the electronics assembly is configured to record downhole environmental data from the one or sensors at a rate of at least about 1,000 Hz.

9. The wellbore logging device as in claim 1 wherein the largest dimension of the wellbore logging device is less than or equal to about 2.0 inches.

10. The wellbore logging device as in claim 1 wherein the largest dimension of the wellbore logging device is less than or equal to about 1.5 inches.

11. The wellbore logging device as in claim 1 wherein the largest dimension of the wellbore logging device is less than or equal to about 1.38 inches.

12. The wellbore logging device as in claim 1 wherein one or more of the electrical components are not manufacturer-rated for service in downhole environmental conditions.

13. The wellbore logging device as in claim 1 wherein the wellbore logging device has a cylindrical outer surface.

14. A downhole equipment component having a wellbore logging device as in claim 1 embedded within a cylindrical wall of the downhole equipment component.

15. The downhole equipment component as in claim 14 wherein:

(a) the wellbore logging device is disposed within an instrumentation recess formed into an outer surface of the cylindrical wall of the equipment component; and (b) the wellbore logging device is protected by a pressure cap sealingly and removably disposed within the instrumentation recess after the wellbore logging device has been positioned therein.

16. The downhole equipment component as in claim 15 wherein the pressure cap is a windowed pressure cap.

17. The wellbore logging device as in claim 1 wherein the power module is slidingly mountable to the electronics module by means of a T-shaped or dovetail-type slot on the power module and a corresponding T-shaped or dovetail-type protrusion on the electronics module.

* * * * *